US008624119B2

(12) United States Patent
Takahashi et al.

(10) Patent No.: US 8,624,119 B2
(45) Date of Patent: Jan. 7, 2014

(54) CONDUCTOR OF AN ELECTRICAL WIRE FOR WIRING, METHOD OF PRODUCING A CONDUCTOR OF AN ELECTRICAL WIRE FOR WIRING, ELECTRICAL WIRE FOR WIRING, AND COPPER ALLOY SOLID WIRE

(75) Inventors: Isao Takahashi, Tokyo (JP); Masanobu Hirai, Tokyo (JP); Kensaku Oda, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 9 days.

(21) Appl. No.: 13/190,081

(22) Filed: Jul. 25, 2011

(65) Prior Publication Data

US 2012/0018192 A1 Jan. 26, 2012

Related U.S. Application Data

(63) Continuation of application No. PCT/JP2010/050993, filed on Jan. 26, 2010.

(30) Foreign Application Priority Data

Jan. 26, 2009 (JP) ..... 2009-014420
Dec. 24, 2009 (JP) ..... 2009-292071

(51) Int. Cl.
*H01B 5/08* (2006.01)

(52) U.S. Cl.
USPC ..... 174/128.1

(58) Field of Classification Search
USPC ..... 174/102 R, 126.1, 126.2, 128.1, 128.2
See application file for complete search history.

(56) References Cited

U.S. PATENT DOCUMENTS

| | | | | |
|---|---|---|---|---|
| 2007/0017691 | A1* | 1/2007 | Izumida et al. | 174/110 R |
| 2007/0221396 | A1* | 9/2007 | Izumida et al. | 174/128.1 |
| 2009/0165902 | A1 | 7/2009 | Yoshida et al. | |

FOREIGN PATENT DOCUMENTS

| | | | | |
|---|---|---|---|---|
| JP | 3-162539 A | | 7/1991 | |
| JP | 6-49592 A | | 2/1994 | |
| JP | 06-089620 | * | 3/1994 | H01B 13/02 |
| JP | 6-89620 A | | 3/1994 | |
| JP | 6-316735 A | | 11/1994 | |
| JP | 09-067629 | * | 3/1997 | C22C 9/00 |
| JP | 9-67629 A | | 3/1997 | |
| JP | 9-190718 A | | 7/1997 | |
| JP | 2000-073153 A | * | 3/2000 | C22F 1/08 |
| JP | 2000-73153 A | | 3/2000 | |
| JP | 2001-234309 | * | 8/2001 | C22F 1/08 |
| JP | 2001-234309 A | | 8/2001 | |
| JP | 2008-016284 | * | 1/2008 | H01B 5/08 |
| JP | 2008-16284 A | | 1/2008 | |
| JP | 2008-088549 | * | 4/2008 | C22F 1/08 |
| JP | 2008-88549 A | | 4/2008 | |
| JP | 2008-266764 A | | 11/2008 | |

OTHER PUBLICATIONS

International Search Report for PCT/JP2010/050993, mailed on Apr. 20, 2010.

* cited by examiner

*Primary Examiner* — William H Mayo, III
(74) *Attorney, Agent, or Firm* — Birch, Stewart, Kolasch & Birch, LLP

(57) ABSTRACT

A conductor of an electrical wire for wiring is disclosed. The conductor is obtained by stranding a plurality of copper alloy wire materials, each having a composition containing 0.3 to 1.5 mass % of Cr, with the balance being Cu and inevitable impurities. The conductor has a tensile strength of 400 MPa or more and 650 MPa or less, an elongation of 7% or more when broken, an electrical conductivity of 65% IACS or more, a ratio between a 0.2% proof stress and the tensile strength of 0.7 or more and 0.95 or less, and a work-hardening exponent of 0.03 or more and 0.17 or less. A method of producing the conductor; an electrical wire for wiring, in which an insulating cover is provided on the conductor; and a copper alloy solid wire for the conductor are also disclosed.

24 Claims, No Drawings

CONDUCTOR OF AN ELECTRICAL WIRE FOR WIRING, METHOD OF PRODUCING A CONDUCTOR OF AN ELECTRICAL WIRE FOR WIRING, ELECTRICAL WIRE FOR WIRING, AND COPPER ALLOY SOLID WIRE

CROSS REFERENCE TO RELATED APPLICATIONS

This application is a Continuation of PCT International Application No. PCT/JP2010/050993 filed on Jan. 26, 2010, which claims priority of Application Nos. 2009-014420 and 2009-292071 filed in Japan on Jan. 26, 2009 and Dec. 24, 2009, respectively. All of which are hereby expressly incorporated by reference into the present application.

TECHNICAL FIELD

The present invention relates to a conductor of an electrical wire for wiring in electrical/electronic equipments, or the like, and to an electrical wire for wiring utilizing the same.

BACKGROUND ART

Conventionally, as a conductor of an electrical wire for wiring in automobiles, robots, electrical/electronic equipments, and the like, the followings have been mainly used: an electrical annealed copper wire, as stipulated under JIS C 3102; or an electrical wire (coated electrical wire) obtained by stranding plated wires, which are each obtained by plating that annealed copper wire with tin, or the like, to give a stranded wire, and covering the resultant stranded wire with an insulating substance, such as vinyl chloride or crosslinked polyethylene.

When those electrical wires are connected to an equipment, a terminal called a crimping terminal (or solderless terminal) is generally connected to the electrical wires by crimping, and then the thus-crimped terminal connected to the electrical wires is connected to the equipment. The crimping connection is a method of wrapping electrical wires in (or sandwiching those with) a terminal material, and then caulking (or fastening) the material, to ensure electrical connection.

As a method of evaluating the state of connection by crimping, there is a method of testing on the basis of "Tensile Strength of Crimp Contact" in JIS C 5402 (Method of Testing Connectors for Electronic Equipments). This is a method of: connecting electrical wires to a crimping terminal, and then gripping each of the ends of the thus-crimped terminal connected with the wires, to conduct a tensile test, thereby measuring the strength when broken. In general, at the crimped part, the caulking makes the sectional area of the conductor smaller by 20 to 30% than that of the conductor before the caulking (hereinafter, the percentage of a reduction in the sectional area of a conductor by caulking is referred to as the "sectional area reduction" (of the conductor)). Thus, the absolute value of the mechanical strength of the conductor is lowered at the crimped part. As a result, usually, the breakage occurs at the caulked part.

In the meantime, for example, in an automobile wiring circuit, the number of electrical wires to be used has been increased, since the electronic technology of controlling and the like has been advanced. Along with that, the total weight of the electrical wires therein has been increasing. However, the lightening of weights of automobiles has been required, from the viewpoint of energy saving. As a measure therefor, the diameters of conductors of electrical wires are required to be made small, thereby making the total weight of the electrical wires lightened.

However, although the above-mentioned annealed copper wire, which constitutes a conventional conductor of an electrical wire, has a room sufficient for electric conduction capacity, the copper wire is not easily made small in diameter. This is because the mechanical strength of the conductor of an electrical wire itself is small. Further, the crimping strength of the annealed copper wire at the crimped part is substantially equal to that at the non-crimped part, since the conductor itself may undergo work-hardening even when the sectional area of the conductor is decreased by caulking. Thus, the stability of the crimping strength is high, but the copper wire has a big problem that the strength thereof itself is low since the wire is made of annealed copper.

Thus, as a measure for enhancing the mechanical strength of the crimped part, study has been made on, for example, the use of a copper alloy hard material (see Patent Literature 1). Further, study has been made on the use of an age-precipitating copper alloy (of a Cu—Ni—Si-based, so called Corson alloy) in copper alloy wires which are excellent in flexure resistance, and which can decrease occurrence of wire-breakage due to tension at the crimped terminal part (see Patent Literature 2). Furthermore, study has also been made on improvement in properties of age-precipitating copper alloy wires (see Patent Literatures 3 and 4).

CITATION LIST

Patent Literature

Patent Literature 1: JP-A-2008-016284 ("JP-A" means unexamined published Japanese patent application)
Patent Literature 2: JP-A-3-162539
Patent Literature 3: JP-A-2008-266764
Patent Literature 4: JP-A-2008-088549

SUMMARY OF INVENTION

Technical Problem

In the meantime, about the conductor of an electrical wire described in Patent Literature 1, which is made of a copper alloy hard material, it is presumed that work-hardening of the conductor itself is substantially saturated. In this case, the absolute strength of the conductor of the electrical wire at a crimped part is lowered, by a decrease in the sectional area of the conductor due to caulking upon connecting a crimped terminal to the conductor. As a result, a stable crimping strength may not be obtained. Moreover, the conductor is hard and has no sufficient elongation, and the wire of this conductor is apt to cause wire-breakage when an impact force is applied thereto. In connection with flexibility, the wire is excellent in fatigue characteristic when the wire receives a low strain based on vibration or the like; however, the wire may be broken by high-strain repeated-bending given at the time of wire arrangement.

The conductor of an electrical wire described in Patent Literature 2, made of age-precipitating copper alloy (Corson alloy), is high in elongation, and is excellent in crimping strength and impact resistance, and can be used as an electrical wire for a signal circuit. However, the electrical wire has a problem of low electrical conductivity to be used as an electrical wire for electric power as is used in a fuse circuit.

Further, Patent Literature 3 describes that quenching (quench-hardening) at a high temperature is conducted when obtaining a roughly-drawn wire (or wire rod) of a copper alloy by a continuous casting and rolling method; and Patent Literature 4 describes that a copper alloy wire is subjected to heat treatment for aging. However, in order to further improve properties of conductors of electrical wires, it is necessary to study in detail on technical matters other than the techniques described in Patent Literatures 3 to 4.

In view of the above-mentioned problems, the present invention has been made. The present invention is contemplated for providing a conductor of an electrical wire for wiring, which has a high electrical conductivity enough for permitting the electrical wire to be used, for example, as an electrical wire for electric power in an automobile, which is high in mechanical strength and elongation, and which is excellent in terminal crimping strength, impact breakdown strength, and flexibility; and the present invention is also contemplated for providing a method of producing the conductor of an electrical wire for wiring.

Solution to Problem

The inventors of the present invention, having studied keenly, found that a copper alloy wire material for solving the above-mentioned problems can be obtained, by use of an age-precipitating copper alloy of a specific composition. Furthermore, the inventors found that a conductor of an electrical wire for wiring can be obtained with a good reproducibility, by stranding the above-mentioned wire materials, in which the ratio between 0.2% proof stress (yield strength) and tensile strength is set to 0.7 or more and 0.95 or less, and in which the work-hardening exponent is set to 0.03 or more and 0.17 or less, setting properly the condition of the working ratio (wire drawing ratio) after solution treatment, and further conducting age-annealing (heat treatment) to carry out as the final step.

According to the present invention, there is provided the following means:

(1) A conductor of an electrical wire for wiring, which is obtained by stranding a plurality of copper alloy wire materials each having a composition containing 0.3 to 1.5 mass % of Cr, with the balance being Cu and inevitable impurities, and which has a tensile strength of 400 MPa or more and 650 MPa or less, an elongation of 7% or more when broken, an electrical conductivity of 65% IACS or more, a ratio between a 0.2% proof stress and the tensile strength of 0.7 or more and 0.95 or less, and a work-hardening exponent of 0.03 or more and 0.17 or less.

(2) A conductor of an electrical wire for wiring, which is obtained by stranding a plurality of copper alloy wire materials each having a composition containing 0.3 to 1.5 mass % of Cr and 0.005 to 0.4 mass % of Zr, with the balance being Cu and inevitable impurities, and which has a tensile strength of 400 MPa or more and 650 MPa or less, an elongation of 7% or more when broken, an electrical conductivity of 65% IACS or more, a ratio between a 0.2% proof stress and the tensile strength of 0.7 or more and 0.95 or less, and a work-hardening exponent of 0.03 or more and 0.17 or less.

(3) The conductor of an electrical wire for wiring according to the above item (1) or (2), wherein the composition of the copper alloy wire materials further contains at least one selected from the group consisting of 0.1 to 0.6 mass % of Sn, 0.005 to 0.3 mass % of Ag, 0.05 to 0.4 mass % of Mg, 0.1 to 0.8 mass % of In, and 0.01 to 0.15 mass % of Si.

(4) The conductor of an electrical wire for wiring according to the above item (3), wherein the composition of the copper alloy wire materials contains the at least one selected from the group consisting of 0.1 to 0.6 mass % of Sn, 0.005 to 0.3 mass % of Ag, 0.05 to 0.4 mass % of Mg, 0.1 to 0.8 mass % of In, and 0.01 to 0.15 mass % of Si, in a total content thereof in an amount of 0.005 to 0.8 mass %.

(5) The conductor of an electrical wire for wiring according to any one of the above items (1) to (4), wherein the composition of the copper alloy wire materials further contains 0.1 to 1.5 mass % of Zn.

(6) A method of producing the conductor of an electrical wire for wiring according to any one of the above items (1) to (5), comprising the steps of:

subjecting a copper alloy having the composition to solution treatment;

drawing the copper alloy to a predetermined wire diameter, to give the copper alloy wire materials;

stranding a plurality of the copper alloy wire materials, to give a stranded wire;

compressing the stranded wire; and subjecting the stranded wire thus compressed to aging heat treatment at 300 to 550° C. for 1 minute to 5 hours.

(7) The method of producing the conductor of an electrical wire for wiring according to the above item (6), wherein a wire-drawing ratio $\eta$ in the drawing step is 5 or more, which is represented by: $\eta=\ln(A_0/A_1)$, in which $A_0$ represents a cross sectional area of the material just after the solution treatment, and $A_1$ represents a cross sectional area of the material just before the aging.

(8) An electrical wire for wiring, wherein an insulating cover is provided on the conductor of an electrical wire for wiring according to any one of the above items (1) to (5).

(9) A copper alloy solid wire, which is used for the copper alloy wire materials in the conductor of an electrical wire for wiring according to any one of the above items (1) to (5), which has the composition according to any one of the above items (1) to (4), and which has an electrical resistivity of 70% or more of an electrical resistivity after conducted the solution treatment fully.

Advantageous Effects of Invention

Since the conductor of an electrical wire for wiring of the present invention, is obtained by stranding a plurality of copper alloy wire materials of a composition containing 0.3 to 1.5 mass % of Cr, and has a tensile strength of 400 MPa or more and 650 MPa or less, an elongation of 7% or more when broken, an electrical conductivity of 65% IACS or more, a ratio between a 0.2% proof stress and the tensile strength of 0.7 or more and 0.95 or less, and further a work-hardening exponent of 0.03 or more and 0.17 or less, the wire materials can be made small in diameter, and the resultant conductor is excellent in electrical conductivity and is further excellent in terminal crimping strength, and impact breakdown strength, and flexibility.

Further, the method of the present invention of producing the conductor of an electrical wire for wiring, allows production of the conductor of an electrical wire for wiring having excellent physical properties described above.

The electrical wire for wiring of the present invention is capable of reducing a weight of the electrical wire by reducing a diameter of the conductor, and is preferably applied to an electrical wire for automobiles, robots, or the like.

MODE FOR CARRYING OUT THE INVENTION

A preferred embodiment of the copper (Cu) alloy wire material to be used for the conductor of an electrical wire for wiring of the present invention, is described in detail. First, actions and effects of the alloying elements and the ranges of contents thereof are described.

Chromium (Cr) is an element to be contained to enhance the mechanical strength of the copper alloy, by forming a precipitation in the matrix. The content of Cr is from 0.3 to 1.5 mass %, preferably from 0.5 to 1.4 mass %. If the amount of Cr is too small, the precipitation hardening amount is small, so that the copper alloy is insufficient in mechanical strength. If the content is too large, the advantageous action is saturated so that a further enhancement of the mechanical strength cannot be expected.

Zirconium (Zr) is an element that can be contained to enhance the mechanical strength of the copper alloy, by forming a precipitation in the matrix, in the same manner as chromium (Cr). The content of Zr is from 0.005 to 0.4 mass %, preferably from 0.01 to 0.3 mass %. If the content of Zr is too small, the precipitation hardening amount is small, and no contribution to the enhancement of the mechanical strength is seen. If the content is too large, the advantageous action is saturated so that a further enhancement of the mechanical strength cannot be expected.

The copper alloy wire material to be used for the conductor of an electrical wire for wiring in the present embodiment, preferably contains at least one of tin (Sn), silver (Ag), magnesium (Mg), indium (In), and silicon (Si), in the respective content as described above. These elements have similar functions with each other, in the viewpoint of enhancing the mechanical strength. In the case where any of those elements are contained, at least one element selected from the group consisting of Sn, Ag, Mg, In, and Si is contained in the total amount thereof in an amount of preferably 0.005 to 0.8 mass %, more preferably 0.01 to 0.7 mass %.

Sn can enhance the mechanical strength, by forming a solid solution in Cu and distorting the lattice. However, if the Sn content is too large, the electrical conductivity is lowered. Thus, when Sn is contained, the Sn content is preferably 0.1 to 0.6 mass %, more preferably 0.2 to 0.5 mass %.

Ag enhances the mechanical strength. If the Ag content is too small, the advantageous action is not sufficiently obtained. If the content is too large, the advantageous action is saturated, to increase costs, despite of no adverse affection onto properties of the resultant alloy. From those viewpoints, when Ag is contained, the content of Ag is preferably 0.005 mass % to 0.3 mass %, more preferably 0.01 to 0.2 mass %.

Mg can enhance the mechanical strength, by forming a solid solution in Cu and distorting the lattice. Moreover, Mg also has effects of preventing the resultant alloy from being made brittle upon heating, and improving the hot workability of the alloy. When Mg is contained, the content of Mg is preferably 0.05 to 0.4 mass %, more preferably 0.1 to 0.3 mass %.

In can enhance the mechanical strength, by forming a solid solution in Cu and distorting the lattice. However, if the In content is too large, the electrical conductivity is lowered. Thus, when In is contained, the In content is preferably 0.1 to 0.8 mass %, more preferably 0.2 to 0.7 mass %.

Si can enhance the mechanical strength, by forming a solid solution in Cu and distorting the lattice. However, if the Si content is too large, the electrical conductivity is lowered, and further the excess Si forms a compound together with Cr, to decrease the amount of Cr to contribute to precipitation hardening. Thus, when Si is contained, the Si content is preferably 0.01 to 0.15 mass %, more preferably 0.05 to 0.1 mass %.

Further, in the copper alloy wire material to be used for the conductor of an electrical wire for wiring in the present embodiment, it is preferable to contain zinc (Zn). Zn has an effect of preventing lowering of adhesion force of the copper alloy wire material with solder upon heating. In the present invention, by containing Zn, it is possible to remarkably improve embrittlement at the interface when the copper alloy wire material is soldered to bond with other conductors, or the like. In the present invention, the Zn content is preferably 0.1 to 1.5 mass %, more preferably 0.2 to 1.3 mass %. If the Zn content is too small, the above-mentioned effects may not be exhibited in some cases. To the contrary, if the Zn content is too large, electrical conductivity may be lowered, in some cases.

Herein, a description is made on mechanical properties of the copper alloy wire materials used for the conductor of an electrical wire for wiring of the present embodiment.

The copper alloy wire materials used for the conductor of an electrical wire for wiring of the present embodiment are constituted with an age-precipitating alloy. The copper alloy wire materials are obtained, for example, as follows. First, alloy materials are melted and cast, to form an ingot, billet, or the like; and this ingot, billet, or the like is subjected to hot working (or alloy materials are subjected to continuous casting and rolling), to give copper alloy solid wires. Then, the copper alloy solid wires are subjected to cold working, followed by solution treatment, and then drawn to a predetermined diameter (wire diameter), to give copper alloy wire materials. The resultant plurality of copper alloy wire materials are stranded, followed by, optional compressing to a predetermined stranded wire diameter, and aging heat treatment.

As can be seen in the above, herein, in the present specification, the terms "copper alloy wire material(s)" mean the state after drawn, and the terms "copper alloy solid wire(s)" mean the state before drawing. The copper alloy solid wires each are preferably made into a diameter of 1 to 20 mm. The solution treatment may be conducted at the same time when the hot working or the continuous casting and rolling is conducted, so that the step (only for the solution treatment) may be omitted. Further, the cold working may be omitted.

The wire diameter of each of the copper alloy wire materials is set preferably to 0.05 to 0.3 mm, more preferably to 0.1 to 0.2 mm, from the viewpoints of satisfying readily the above-mentioned various properties (electrical conductivity, mechanical strength, elongation, terminal crimping strength, impact breakdown strength, flexibility, and the like).

The conductor of an electrical wire for wiring of the present invention is a stranded wire obtained by stranding a plurality of copper alloy wire materials. The number of copper alloy wire materials to be stranded is not particularly limited, and generally 3 to 50 copper alloy wire materials are stranded.

Upon the aging heat treatment, a precipitation of Cr and Zr if present, is generated, so that the copper alloy is enhanced in mechanical strength and improved in electrical conductivity. At the same time, however, a strain introduced by drawing is released, so as to lower the ratio of 0.2% proof stress (Y) to tensile strength (T), which is called the Y/T ratio. The conditions of the aging heat treatment by which the Y/T ratio is lowered, vary, according to the wire-drawing ratio. By keeping the copper alloy, for example, at 300 to 550° C. for 1 minute to 5 hours, copper alloy wire materials having an appropriate Y/T ratio can be obtained.

In the present invention, the aging heat treatment may be conducted as an aging heat treatment by continuous heating in a short time period (for example, for 1 to 3 minutes, at 400 to 550° C.), or alternatively as a batch-type aging heat treatment (for example, for 1 to 5 hours, at 300 to 500° C.). In any one of those, it is sufficient to adjust the conditions for the aging heat treatment to attain the predetermined Y/T ratio.

If the aging heat treatment conditions result in the Y/T ratio of less than 0.7, the resultant conductor is low in the mechanical strength due to overaging, which is unsuitable for the use as electrical wires. When the conditions result in the Y/T ratio of 0.7 to 0.95, preferably 0.72 to 0.93, the resultant conductor itself has a large degree in work-hardening when a terminal is crimped thereto, so that a lowering of the strength at the crimped part is small. If the conditions result in the Y/T ratio of more than 0.95, the resultant conductor does not release strain sufficiently. In that case, the conductor itself has a small degree in work-hardening when a terminal is crimped thereto. As a result, a lowering of the strength at the crimped part is large, when use is made of an alloying element(s) or production process making the strength finished as aging heat treated lowered.

The following describes properties of the conductor of an electrical wire for wiring. If the sectional area reduction upon crimping is too large, the absolute strength tends to be lowered conspicuously regardless of the Y/T ratio. Thus, the sectional area reduction is preferably 40% or less, more preferably 30% or less. If the sectional area reduction is too small, the conductor falls out easily from the caulked part of the terminal, so that the electrical connection therebetween, which is a primary target, becomes insufficient. Thus, the sectional area reduction is preferably 5% or more, more preferably 10% or more.

With respect to the conductor of an electrical wire for wiring of the present embodiment, a basic embodiment is a conductor obtained by drawing a material (copper alloy solid wires) and then subjecting the drawn wires to a wire-stranding step. The aging heat treatment may be conducted before or after the wire-stranding step. Further, a compressing step may be added after the wire-stranding step. In that case, the aging heat treatment may be conducted any of before or after the compressing step. When the aging heat treatment is conducted before the compressing step, it is sufficient that the sectional area reduction upon crimping is set to 40% or less including the sectional area reduction in the compression.

The work-hardening exponent, which is called the "n value" herein, is a value representing workability. The work-hardening exponent means an exponent n obtained when a relationship (curve) between stress $\sigma$ and strain $\epsilon$ in the plastic zone at the yielding point or higher is approximated to: $\sigma=C\epsilon^n$, in which C is a constant. As this n value is larger, the distribution of the strain is more equalized. In the present invention, the inventors, having studied keenly, found that the present alloy system can exhibit an excellent crimping strength when the Y/T ratio satisfies to be within a range from 0.7 to 0.95 and the n value is from 0.03 to 0.17.

A preferable condition in the steps from the drawing of the material (the copper alloy solid wires), which has been subjected to solution treatment, to the aging heat treatment, is as follows: That is, the wire-drawing ratio $\eta$ in the drawing is preferably 5 or more, more preferably 6 or more and 11 or less, which is represented by: $\eta=\ln(A_0/A_1)$, in which $A_0$ represents a cross sectional area of the material just after the solution treatment, and $A_1$ represents a cross sectional area of the material just before the aging. If the value $\eta$ is 3 or less, the conductor tends to become low in electrical conductivity, elongation, and load at impact breakdown.

The solution treatment of the material (the copper alloy solid wires) needs to be sufficiently conducted. In general, however, the temperature necessary for conducting a full solution treatment is close to the melting point of the material (the copper alloy solid wires), thus, it is difficult to conduct a full solution treatment industrially. In a case where the material (the copper alloy solid wires) when the thermal solution treatment is conducted is large in wire diameter, the cooling of the central part of the material is delayed when the material is cooled after the solution treatment, and a precipitation is generated in the material. As a result, the solution treatment is not fully conducted. Thus, in the present invention, it is sufficient that the degree of the solution treatment is adjusted as follows.

That is, when the electrical resistivity after subjected to a solution treatment is represented by p, and the electrical resistivity when subjected to a full solution treatment is represented by $\rho_{FULL}$, the value of $\rho/\rho_{FULL}$, which is called the solution treatment ratio, is set to 0.7 or more, preferably 0.75 or more. If the solution treatment ratio is too small, a precipitation is not sufficiently generated by the aging heat treatment to be conducted later, which results in insufficiently low mechanical strength. The electrical resistivity obtained when the solution treatment is conducted is hardly changed after conducting the drawing.

Accordingly, for example, in a case where the raw materials in the present invention are copper alloy solid wires having diameters of 5 mm, 2.6 mm, 1 mm, or some other millimeters, and when the electrical resistivity of the copper alloy solid wires is 7/10 or more of the electrical resistivity when a full solution treatment is conducted, the above-mentioned properties can be obtained through: drawing the copper alloy solid wires to turn into copper alloy wire materials of the predetermined diameter; and then conducting aging heat treatment.

When the solid wires subjected to the solution treatment are drawn plural times to give copper alloy wire materials, it is sufficient to set the total wire-drawing ratio in the plural wire-drawing steps to 5 or more. The plural times of the wire-drawing steps do not need to be continuously conducted. For example, it is allowable that a consignor draws the solid wires and then ships the thus-drawn wires, and a consignee conducts for further drawing of the drawn wires to give copper alloy wire materials, and then conducting the aging heat treatment.

In the present invention, the method of producing the raw material is not particularly limited. Even when use is made of any production method, for example, of hot extrusion of a billet, hot forging of an ingot, or continuous casting, the production of the conductor of an electrical wire for wiring of the present invention can be attained.

The conductor of an electrical wire for wiring of the present invention is preferable not only as a conductor of an electrical wire but also as an electrical wire for wiring to which an insulating cover is provided. The raw material of the insulating cover is preferably, for example, an olefin-series resin, such as polyethylene and polypropylene, or a polyvinyl chloride (PVC) resin. The olefin-series resin may be used in the state that any of a flame retardant, a crosslinking agent, and others is added thereto, so as to heighten the flame retardancy, the mechanical strength, and other properties.

EXAMPLES

The present invention will be described in more detail based on examples given below, but the invention is not meant to be limited by these.

Examples 1

An alloy of a composition containing alloying elements as shown in Table 1 was melted in a high-frequency melting furnace, followed by casting, to obtain the respective billet of diameter 200 mm. Then, in order to conduct hot working which functioned also as solution treatment, the billet was hot-extruded at 950° C., followed by, immediately thereafter, quenching in water, to obtain copper alloy solid wires of diameter 20 mm. Then, the copper alloy solid wires were cold drawn, to obtain copper alloy wire materials of diameter 0.175 mm. Seven of the thus-obtained copper alloy wire materials were stranded, followed by compressing, to obtain a stranded wire (a conductor of electrical wire for wiring) of a cross sectional area 0.13 $mm^2$. The stranded wire was age heat treated at 400 to 450° C. for 2 hours, followed by covering with an insulating substance (polyethylene), thereby to produce the electrical wire for wiring of length 1 km.

With respect to the thus-obtained electrical wires for wiring, five items of: [1] tensile strength; [2] 0.2% proof stress; [3] elongation; [4] electrical conductivity; and [5] n value, were measured in the state that the wire was a stranded wire (a conductor of an electrical wire) obtained after subjected to the aging heat treatment and before providing the insulating cover. Further, three items of: [6] flexibility (the number of repeated bendings to break); [7] impact breakdown strength; and [8] terminal crimping strength, were measured in the state of the electrical wire after the insulating cover was provided. The results are shown in Table 1. Methods of measuring the above-mentioned eight items are as follows.

(Evaluations of Conductors for Electrical Wires)

[1] Tensile Strength (TS)

The tensile strength of three specimens of the respective conductor was measured, according to JIS Z 2241; and the average value (MPa) is shown.

[2] 0.2% Proof Stress (YS)

According to the offset method described in JIS Z 2241, the stress yielded a permanent elongation of 0.2% was measured, with respect to three specimens of the respective conductor. The average value (MPa) is shown.

[3] Elongation (El)

The elongation of three specimens of the respective conductor was measured, according to JIS Z 2241; and the average value (%) is shown.

[4] Electrical Conductivity (EC)

The electrical conductivity of two specimens of the respective conductor was measured, with a four-terminal method, in a thermostat bath controlled at 20° C. (±1° C.); and the average value (% IACS) is shown.

[5] n Value

A stress-strain curve obtained in the tensile test was converted to a true-stress versus true-strain curve, to read out the n value from the inclination on the curve.

(Evaluations of Electrical Wires)

[6] Flexibility (the Number of Repeated Bendings to Break)

With respect to evaluation on flexibility, the electrical wire was clamped with a mandrel, and a load was applied thereto by hanging a weight on a lower end of the sample for suppressing distortion of the wire. In that state, the electrical wire was bent to right and left sides by 90°, and the number of bending to break was measured for each sample. With respect to the number of bendings, the whole of a bending of the electrical wire by 90° and the returning thereof was counted as one. The weight was 400 g; and the diameters of the two kinds of mandrels to be used were set to 25 mmϕ (for applying a low strain) or 5 mmϕ (for applying a high strain), for the respective evaluation of flexibility. Under applying the low strain, in a case where no breakage occurred even when the number of bendings was over 3,000, the test was stopped, to conclude that such a sample was not broken (No breakage). Under applying the high strain, in a case where no breakage occurred even when the number of bendings was over 300, the test was stopped, to conclude that such a sample was not broken (No breakage). With respect to the above two kinds of strains for each of the samples, the measurement was made three times, and the smallest value was recorded.

[7] Impact Breakdown Strength

One of the ends of a 1 m-length test piece of the respective electrical wire was fixed; and to the other end, a weight was attached. From the position of the fixed end, the weight was dropped, to determine the weight or force (N) when the electrical wire was broken. In this way, the impact breakdown strengths of the electrical wires were compared with each other. The test was repeated 3 times with the weight when the breakage occurred. In each of the repeated tests, the load when the electrical wire was broken was measured. It should be noted that, in practical use, when the load at breakage is less than 4N, the wire may be unfavorably broken in the arrangement of the wire.

[8] Terminal Crimping Strength

The electrical wire was connected to a crimping terminal, and both ends of the connected members were gripped, and a tensile test was conducted. The strength when the electrical wire was broken was measured. The sectional area reduction in the crimping was set to 20%. It should be noted that, in practical use, when the crimping strength is less than 50 N, there is a high possibility that the electrical wire is broken in or after the arrangement of the wire.

In the following tables, a working example according to this invention (i.e. Example) is abbreviated to "Ex".

TABLE 1

| | Alloying elements (mass %) | | | | | | | | |
|---|---|---|---|---|---|---|---|---|---|
| | Cr | Zr | Sn | Ag | Mg | In | Si | Zn | Cu |
| Ex 1 | 0.34 | | | | | | | | Balance |
| Ex 2 | 0.58 | | | | | | | | Balance |
| Ex 3 | 0.88 | | | | | | | | Balance |
| Ex 4 | 1.02 | | | | | | | | Balance |
| Ex 5 | 1.12 | | | | | | | | Balance |
| Ex 6 | 1.23 | | | | | | | | Balance |
| Ex 7 | 1.38 | | | | | | | | Balance |
| Ex 8 | 1.47 | | | | | | | | Balance |
| Ex 9 | 0.33 | 0.14 | | | | | | | Balance |
| Ex 10 | 0.50 | 0.01 | | | | | | | Balance |
| Ex 11 | 0.61 | 0.01 | | | | | | | Balance |
| Ex 12 | 0.63 | 0.21 | | | | | | | Balance |
| Ex 13 | 0.63 | 0.35 | | | | | | | Balance |
| Ex 14 | 1.02 | 0.18 | | | | | | | Balance |
| Ex 15 | 1.14 | 0.27 | | | | | | | Balance |
| Ex 16 | 1.23 | 0.03 | | | | | | | Balance |
| Ex 17 | 1.46 | 0.31 | | | | | | | Balance |

TABLE 1-continued

| | | | | | | | | | |
|---|---|---|---|---|---|---|---|---|---|
| Ex 18 | 0.49 | | 0.12 | | | | | | Balance |
| Ex 19 | 0.67 | | 0.32 | | | | | | Balance |
| Ex 20 | 0.96 | | 0.17 | | | | | | Balance |
| Ex 21 | 0.98 | | 0.33 | | | | | | Balance |
| Ex 22 | 1.06 | | 0.35 | | | | | | Balance |
| Ex 23 | 1.21 | | 0.29 | | | | | | Balance |
| Ex 24 | 1.28 | | 0.10 | | | | | | Balance |
| Ex 25 | 1.37 | | 0.18 | | | | | | Balance |
| Ex 26 | 1.40 | | 0.28 | | | | | | Balance |
| Ex 27 | 1.45 | | 0.21 | | | | | | Balance |
| Ex 28 | 0.56 | | | 0.01 | 0.08 | | | | Balance |
| Ex 29 | 1.17 | | | 0.14 | 0.22 | | | | Balance |
| Ex 30 | 0.68 | | 0.22 | | | 0.13 | | | Balance |
| Ex 31 | 1.23 | | 0.13 | | | 0.12 | | | Balance |
| Ex 32 | 0.48 | 0.26 | | 0.26 | | | | | Balance |
| Ex 33 | 0.55 | 0.12 | | | | 0.62 | | | Balance |
| Ex 34 | 0.98 | | | | 0.24 | | | | Balance |
| Ex 35 | 1.43 | | | | 0.32 | | | | Balance |
| Ex 36 | 1.13 | | 0.52 | 0.13 | | | | | Balance |
| Ex 37 | 0.32 | 0.38 | 0.56 | | | | | | Balance |
| Ex 38 | 1.31 | 0.08 | 0.15 | | | | | | Balance |
| Ex 39 | 0.57 | | | 0.22 | | 0.18 | | | Balance |
| Ex 40 | 0.31 | | 0.26 | | | | | 0.19 | Balance |
| Ex 41 | 0.65 | 0.13 | | | | | | 1.39 | Balance |
| Ex 42 | 1.23 | 0.12 | | | | | | 0.53 | Balance |
| Ex 43 | 0.95 | | 0.39 | 0.24 | 0.05 | | | | Balance |
| Ex 44 | 0.46 | 0.11 | 0.32 | 0.14 | 0.10 | 0.18 | | | Balance |
| Ex 45 | 0.62 | | | | | | 0.02 | | Balance |
| Ex 46 | 0.68 | | | | | | 0.15 | | Balance |
| Ex 47 | 0.89 | | 0.13 | | | | 0.09 | | Balance |
| Ex 48 | 1.31 | | 0.11 | | | | 0.05 | | Balance |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Small strain | High strain | (N) | (%) | (N) |
| Ex 1 | 422 | 304 | 14 | 93 | 0.72 | 0.17 | No breakage | No breakage | 5.4 | 20 | 53.2 |
| Ex 2 | 441 | 326 | 13 | 92 | 0.74 | 0.15 | No breakage | No breakage | 5.2 | 20 | 55.6 |
| Ex 3 | 466 | 350 | 12 | 92 | 0.75 | 0.16 | No breakage | No breakage | 5.1 | 20 | 58.7 |
| Ex 4 | 493 | 370 | 12 | 92 | 0.75 | 0.15 | No breakage | No breakage | 5.4 | 20 | 62.1 |
| Ex 5 | 483 | 348 | 13 | 91 | 0.72 | 0.16 | No breakage | No breakage | 5.7 | 20 | 60.9 |
| Ex 6 | 489 | 372 | 12 | 92 | 0.76 | 0.14 | No breakage | No breakage | 5.4 | 20 | 61.6 |
| Ex 7 | 511 | 399 | 11 | 91 | 0.78 | 0.12 | No breakage | No breakage | 5.2 | 20 | 64.3 |
| Ex 8 | 484 | 363 | 12 | 91 | 0.75 | 0.14 | No breakage | No breakage | 5.3 | 20 | 61.0 |
| Ex 9 | 486 | 389 | 11 | 92 | 0.80 | 0.11 | No breakage | No breakage | 5.0 | 20 | 61.0 |
| Ex 10 | 471 | 363 | 12 | 93 | 0.77 | 0.12 | No breakage | No breakage | 5.2 | 20 | 59.3 |
| Ex 11 | 482 | 366 | 11 | 93 | 0.76 | 0.14 | No breakage | No breakage | 4.9 | 20 | 60.7 |
| Ex 12 | 470 | 329 | 15 | 92 | 0.70 | 0.17 | No breakage | No breakage | 6.4 | 20 | 59.4 |
| Ex 13 | 603 | 555 | 7 | 90 | 0.92 | 0.06 | No breakage | No breakage | 4.0 | 20 | 68.8 |
| Ex 14 | 524 | 445 | 10 | 91 | 0.85 | 0.09 | No breakage | No breakage | 4.9 | 20 | 64.6 |
| Ex 15 | 620 | 570 | 7 | 88 | 0.92 | 0.06 | No breakage | No breakage | 4.1 | 20 | 70.7 |
| Ex 16 | 495 | 361 | 13 | 92 | 0.73 | 0.17 | No breakage | No breakage | 5.8 | 20 | 62.4 |
| Ex 17 | 598 | 502 | 10 | 91 | 0.84 | 0.11 | No breakage | No breakage | 5.5 | 20 | 74.1 |
| Ex 18 | 503 | 417 | 11 | 90 | 0.83 | 0.09 | No breakage | No breakage | 5.2 | 20 | 62.6 |
| Ex 19 | 512 | 415 | 10 | 76 | 0.81 | 0.10 | No breakage | No breakage | 4.8 | 20 | 64.1 |
| Ex 20 | 523 | 439 | 11 | 86 | 0.84 | 0.08 | No breakage | No breakage | 5.4 | 20 | 64.8 |
| Ex 21 | 548 | 466 | 10 | 74 | 0.85 | 0.09 | No breakage | No breakage | 5.1 | 20 | 67.5 |
| Ex 22 | 541 | 465 | 10 | 76 | 0.86 | 0.11 | No breakage | No breakage | 5.0 | 20 | 66.2 |
| Ex 23 | 563 | 445 | 11 | 75 | 0.79 | 0.14 | No breakage | No breakage | 5.6 | 20 | 70.8 |
| Ex 24 | 504 | 449 | 9 | 90 | 0.89 | 0.06 | No breakage | No breakage | 4.3 | 20 | 60.0 |
| Ex 25 | 527 | 448 | 10 | 85 | 0.85 | 0.08 | No breakage | No breakage | 4.9 | 20 | 65.0 |
| Ex 26 | 568 | 443 | 12 | 83 | 0.78 | 0.16 | No breakage | No breakage | 6.2 | 20 | 71.5 |
| Ex 27 | 557 | 423 | 12 | 77 | 0.76 | 0.13 | No breakage | No breakage | 6.1 | 20 | 70.2 |
| Ex 28 | 467 | 350 | 13 | 91 | 0.75 | 0.14 | No breakage | No breakage | 5.6 | 20 | 58.9 |
| Ex 29 | 539 | 426 | 10 | 77 | 0.79 | 0.15 | No breakage | No breakage | 4.9 | 20 | 67.8 |
| Ex 30 | 509 | 448 | 9 | 75 | 0.88 | 0.06 | No breakage | No breakage | 4.3 | 20 | 61.3 |
| Ex 31 | 553 | 465 | 11 | 84 | 0.84 | 0.10 | No breakage | No breakage | 5.7 | 20 | 68.5 |
| Ex 32 | 488 | 390 | 10 | 91 | 0.80 | 0.10 | No breakage | No breakage | 4.5 | 20 | 61.3 |
| Ex 33 | 513 | 385 | 12 | 75 | 0.75 | 0.14 | No breakage | No breakage | 5.6 | 20 | 64.7 |
| Ex 34 | 530 | 429 | 11 | 77 | 0.81 | 0.10 | No breakage | No breakage | 5.4 | 20 | 66.4 |
| Ex 35 | 527 | 495 | 8 | 68 | 0.94 | 0.03 | No breakage | No breakage | 4.1 | 20 | 57.8 |
| Ex 36 | 552 | 502 | 8 | 67 | 0.91 | 0.04 | No breakage | No breakage | 4.2 | 20 | 64.0 |
| Ex 37 | 590 | 561 | 7 | 66 | 0.95 | 0.03 | No breakage | No breakage | 4.0 | 20 | 63.2 |
| Ex 38 | 585 | 509 | 10 | 87 | 0.87 | 0.06 | No breakage | No breakage | 5.5 | 20 | 71.1 |
| Ex 39 | 478 | 425 | 9 | 85 | 0.89 | 0.09 | No breakage | No breakage | 4.0 | 20 | 56.9 |
| Ex 40 | 472 | 392 | 10 | 78 | 0.83 | 0.10 | No breakage | No breakage | 4.4 | 20 | 58.8 |

TABLE 1-continued

| | | | | | | | | | | | |
|---|---|---|---|---|---|---|---|---|---|---|---|
| Ex 41 | 527 | 432 | 10 | 80 | 0.82 | 0.11 | No breakage | No breakage | 4.9 | 20 | 65.8 |
| Ex 42 | 590 | 519 | 9 | 89 | 0.88 | 0.08 | No breakage | No breakage | 5.0 | 20 | 71.0 |
| Ex 43 | 508 | 432 | 11 | 67 | 0.85 | 0.08 | No breakage | No breakage | 5.3 | 20 | 62.6 |
| Ex 44 | 549 | 483 | 9 | 66 | 0.88 | 0.08 | No breakage | No breakage | 4.6 | 20 | 66.1 |
| Ex 45 | 458 | 362 | 10 | 91 | 0.79 | 0.12 | No breakage | No breakage | 4.2 | 20 | 57.6 |
| Ex 46 | 502 | 377 | 11 | 65 | 0.75 | 0.16 | No breakage | No breakage | 5.0 | 20 | 63.3 |
| Ex 47 | 524 | 424 | 9 | 67 | 0.81 | 0.10 | No breakage | No breakage | 4.4 | 20 | 65.6 |
| Ex 48 | 533 | 421 | 11 | 75 | 0.79 | 0.12 | No breakage | No breakage | 5.4 | 20 | 67.0 |

Examples 1 to 48 according to the present invention in Table 1, each are satisfactory in tensile strength, elongation, and electrical conductivity; and the Y/T ratios thereof are 0.7 or more and 0.95 or less, and the n values are 0.03 or more and 0.17 or less, thus, in each of those examples, the values of flexibility, impact breakdown strength, and crimping strength each are a practically permissible level.

Examples 2

With respect to Examples 5, 14, 20, 23, 29, and 42 according to the present invention in Table 1, Table 2 shows the crimping strengths obtained when the sectional area reduction in the crimping was set to 10%, 20%, 30%, or 40%, respectively.

TABLE 2

| | Alloying elements (mass %) | | | | | | |
|---|---|---|---|---|---|---|---|
| | Cr | Zr | Sn | Ag | Mg | Zn | Cu |
| Ex 5A-1 | 1.12 | | | | | | Balance |
| Ex 5 | 1.12 | | | | | | Balance |
| Ex 5A-2 | 1.12 | | | | | | Balance |
| Ex 5A-3 | 1.12 | | | | | | Balance |
| Ex 14A-1 | 1.02 | 0.18 | | | | | Balance |
| Ex 14 | 1.02 | 0.18 | | | | | Balance |
| Ex 14A-2 | 1.02 | 0.18 | | | | | Balance |
| Ex 14A-3 | 1.02 | 0.18 | | | | | Balance |
| Ex 20A-1 | 0.96 | | 0.17 | | | | Balance |
| Ex 20 | 0.96 | | 0.17 | | | | Balance |
| Ex 20A-2 | 0.96 | | 0.17 | | | | Balance |
| Ex 20A-3 | 0.96 | | 0.17 | | | | Balance |
| Ex 23A-1 | 1.21 | | 0.29 | | | | Balance |
| Ex 23 | 1.21 | | 0.29 | | | | Balance |
| Ex 23A-2 | 1.21 | | 0.29 | | | | Balance |
| Ex 23A-3 | 1.21 | | 0.29 | | | | Balance |
| Ex 29A-1 | 1.17 | | | 0.14 | 0.22 | | Balance |
| Ex 29 | 1.17 | | | 0.14 | 0.22 | | Balance |
| Ex 29A-2 | 1.17 | | | 0.14 | 0.22 | | Balance |
| Ex 29A-3 | 1.17 | | | 0.14 | 0.22 | | Balance |
| Ex 42A-1 | 1.23 | 0.12 | | | | 0.53 | Balance |
| Ex 42 | 1.23 | 0.12 | | | | 0.53 | Balance |
| Ex 42A-2 | 1.23 | 0.12 | | | | 0.53 | Balance |
| Ex 42A-3 | 1.23 | 0.12 | | | | 0.53 | Balance |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Ex 5A-1 | 483 | 348 | 13 | 91 | 0.72 | 0.16 | No breakage | No breakage | 5.7 | 10 | 62.6 |
| Ex 5 | 483 | 348 | 13 | 91 | 0.72 | 0.16 | No breakage | No breakage | 5.7 | 20 | 60.9 |
| Ex 5A-2 | 483 | 348 | 13 | 91 | 0.72 | 0.16 | No breakage | No breakage | 5.7 | 30 | 55.5 |
| Ex 5A-3 | 483 | 348 | 13 | 91 | 0.72 | 0.16 | No breakage | No breakage | 5.7 | 40 | 50.5 |
| Ex 14A-1 | 524 | 445 | 10 | 91 | 0.85 | 0.09 | No breakage | No breakage | 4.9 | 10 | 68.9 |
| Ex 14 | 524 | 445 | 10 | 91 | 0.85 | 0.09 | No breakage | No breakage | 4.9 | 20 | 64.6 |
| Ex 14A-2 | 524 | 445 | 10 | 91 | 0.85 | 0.09 | No breakage | No breakage | 4.9 | 30 | 58.2 |
| Ex 14A-3 | 524 | 445 | 10 | 91 | 0.85 | 0.09 | No breakage | No breakage | 4.9 | 40 | 52.9 |
| Ex 20A-1 | 523 | 439 | 11 | 86 | 0.84 | 0.08 | No breakage | No breakage | 5.4 | 10 | 69.0 |
| Ex 20 | 523 | 439 | 11 | 86 | 0.84 | 0.08 | No breakage | No breakage | 5.4 | 20 | 64.8 |
| Ex 20A-2 | 523 | 439 | 11 | 86 | 0.84 | 0.08 | No breakage | No breakage | 5.4 | 30 | 58.2 |
| Ex 20A-3 | 523 | 439 | 11 | 86 | 0.84 | 0.08 | No breakage | No breakage | 5.4 | 40 | 53.0 |
| Ex 23A-1 | 563 | 445 | 11 | 75 | 0.79 | 0.14 | No breakage | No breakage | 5.6 | 10 | 74.6 |
| Ex 23 | 563 | 445 | 11 | 75 | 0.79 | 0.14 | No breakage | No breakage | 5.6 | 20 | 70.8 |
| Ex 23A-2 | 563 | 445 | 11 | 75 | 0.79 | 0.14 | No breakage | No breakage | 5.6 | 30 | 63.0 |
| Ex 23A-3 | 563 | 445 | 11 | 75 | 0.79 | 0.14 | No breakage | No breakage | 5.6 | 40 | 57.0 |
| Ex 29A-1 | 539 | 426 | 10 | 77 | 0.79 | 0.15 | No breakage | No breakage | 4.9 | 10 | 71.4 |
| Ex 29 | 539 | 426 | 10 | 77 | 0.79 | 0.15 | No breakage | No breakage | 4.9 | 20 | 67.8 |
| Ex 29A-2 | 539 | 426 | 10 | 77 | 0.79 | 0.15 | No breakage | No breakage | 4.9 | 30 | 60.3 |
| Ex 29A-3 | 539 | 426 | 10 | 77 | 0.79 | 0.15 | No breakage | No breakage | 4.9 | 40 | 54.6 |

TABLE 2-continued

| | | | | | | | | | | | |
|---|---|---|---|---|---|---|---|---|---|---|---|
| Ex 42A-1 | 590 | 519 | 9 | 89 | 0.88 | 0.08 | No breakage | No breakage | 5.0 | 10 | 76.4 |
| Ex 42 | 590 | 519 | 9 | 89 | 0.88 | 0.08 | No breakage | No breakage | 5.0 | 20 | 71.0 |
| Ex 42A-2 | 590 | 519 | 9 | 89 | 0.88 | 0.08 | No breakage | No breakage | 5.0 | 30 | 64.5 |
| Ex 42A-3 | 590 | 519 | 9 | 89 | 0.88 | 0.08 | No breakage | No breakage | 5.0 | 40 | 58.3 |

As is apparent from Table 2, in Examples 5, 5A-1 to 5A-3, 14, 14A-1 to 14A-3, 20, 20A-1 to 20A-3, 23, 23A-1 to 23A-3, 29, 29A-1 to 29A-3, 42, and 42A-1 to 42A-3 according to the present invention, the crimping strength is decreased as the sectional area reduction in the crimping is increased. Nonetheless, the crimping strength of each of those examples according to the present invention is a value of 50 N or more, which is a practically permissible level.

Examples 3

With respect to Examples 14, 23, 36, 42, and 47 according to the present invention in Table 1, electrical wires with sectional area 0.13 $mm^2$ were produced in the same manner as in Example 1, except that the dimension of the material (i.e. the diameters of the copper alloy solid wires) to be subjected to the solution treatment was changed, so that the wire-drawing ratio η would be varied to 1, 3, 5, 7, 9, and 11, respectively. Properties of the resultant electrical wires are shown in Table 3.

In the following tables, a comparative example (i.e. Comparative example) is abbreviated to "Comp Ex".

TABLE 3

| | Alloying elements (mass %) | | | | | | | Wire-drawing ratio η |
|---|---|---|---|---|---|---|---|---|
| | Cr | Zr | Sn | Ag | Si | Zn | Cu | before aging |
| Ex 14B-1 | 1.02 | 0.18 | | | | | Balance | 11 |
| Ex 14 | 1.02 | 0.18 | | | | | Balance | 9 |
| Ex 14B-2 | 1.02 | 0.18 | | | | | Balance | 7 |
| Ex 14B-3 | 1.02 | 0.18 | | | | | Balance | 5 |
| Comp Ex X1 | 1.02 | 0.18 | | | | | Balance | 3 |
| Comp Ex X2 | 1.02 | 0.18 | | | | | Balance | 1 |
| Ex 23B-1 | 1.21 | | 0.29 | | | | Balance | 11 |
| Ex 23 | 1.21 | | 0.29 | | | | Balance | 9 |
| Ex 23B-2 | 1.21 | | 0.29 | | | | Balance | 7 |
| Ex 23B-3 | 1.21 | | 0.29 | | | | Balance | 5 |
| Comp Ex X3 | 1.21 | | 0.29 | | | | Balance | 3 |
| Comp Ex X4 | 1.21 | | 0.29 | | | | Balance | 1 |
| Ex 36B-1 | 1.13 | | 0.52 | 0.13 | | | Balance | 11 |
| Ex 36 | 1.13 | | 0.52 | 0.13 | | | Balance | 9 |
| Ex 36B-2 | 1.13 | | 0.52 | 0.13 | | | Balance | 7 |
| Ex 36B-3 | 1.13 | | 0.52 | 0.13 | | | Balance | 5 |
| Comp Ex X5 | 1.13 | | 0.52 | 0.13 | | | Balance | 3 |
| Comp Ex X6 | 1.13 | | 0.52 | 0.13 | | | Balance | 1 |
| Ex 42B-1 | 1.23 | 0.12 | | | | 0.53 | Balance | 11 |
| Ex 42 | 1.23 | 0.12 | | | | 0.53 | Balance | 9 |
| Ex 42B-2 | 1.23 | 0.12 | | | | 0.53 | Balance | 7 |
| Ex 42B-3 | 1.23 | 0.12 | | | | 0.53 | Balance | 5 |
| Comp Ex X7 | 1.23 | 0.12 | | | | 0.53 | Balance | 3 |
| Comp Ex X8 | 1.23 | 0.12 | | | | 0.53 | Balance | 1 |
| Ex 47B-1 | 0.89 | | 0.13 | | 0.09 | | Balance | 11 |
| Ex 47 | 0.89 | | 0.13 | | 0.09 | | Balance | 9 |
| Ex 47B-2 | 0.89 | | 0.13 | | 0.09 | | Balance | 7 |
| Ex 47B-3 | 0.89 | | 0.13 | | 0.09 | | Balance | 5 |
| Comp Ex X9 | 0.89 | | 0.13 | | 0.09 | | Balance | 3 |
| Comp Ex X10 | 0.89 | | 0.13 | | 0.09 | | Balance | 1 |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Ex 14B-1 | 525 | 446 | 9 | 91 | 0.85 | 0.09 | No breakage | No breakage | 4.4 | 20 | 64.7 |
| Ex 14 | 524 | 445 | 10 | 91 | 0.85 | 0.09 | No breakage | No breakage | 4.9 | 20 | 64.6 |
| Ex 14B-2 | 518 | 440 | 10 | 90 | 0.85 | 0.10 | No breakage | No breakage | 4.6 | 20 | 63.8 |
| Ex 14B-3 | 515 | 443 | 9 | 88 | 0.86 | 0.08 | No breakage | No breakage | 4.3 | 20 | 63.1 |
| Comp Ex X1 | 520 | 452 | 6 | 87 | 0.87 | 0.09 | No breakage | No breakage | 3.1 | 20 | 63.2 |
| Comp Ex X2 | 511 | 445 | 6 | 84 | 0.87 | 0.08 | No breakage | No breakage | 2.9 | 20 | 62.1 |
| Ex 23B-1 | 560 | 437 | 10 | 75 | 0.78 | 0.13 | No breakage | No breakage | 5.1 | 20 | 70.5 |
| Ex 23 | 563 | 445 | 11 | 75 | 0.79 | 0.14 | No breakage | No breakage | 5.6 | 20 | 70.8 |

TABLE 3-continued

| | | | | | | | | | | | |
|---|---|---|---|---|---|---|---|---|---|---|---|
| Ex 23B-2 | 555 | 433 | 11 | 73 | 0.78 | 0.13 | No breakage | No breakage | 5.6 | 20 | 69.9 |
| Ex 23B-3 | 551 | 441 | 8 | 74 | 0.80 | 0.12 | No breakage | No breakage | 4.1 | 20 | 69.2 |
| Comp Ex X3 | 572 | 458 | 6 | 69 | 0.80 | 0.12 | No breakage | No breakage | 3.3 | 20 | 71.8 |
| Comp Ex X4 | 571 | 463 | 6 | 67 | 0.81 | 0.11 | No breakage | No breakage | 3.1 | 20 | 71.5 |
| Ex 36B-1 | 555 | 500 | 7 | 67 | 0.90 | 0.05 | No breakage | No breakage | 4.0 | 20 | 65.3 |
| Ex 36 | 552 | 502 | 8 | 67 | 0.91 | 0.04 | No breakage | No breakage | 4.2 | 20 | 64.0 |
| Ex 36B-2 | 545 | 496 | 9 | 67 | 0.91 | 0.05 | No breakage | No breakage | 4.6 | 20 | 63.2 |
| Ex 36B-3 | 560 | 504 | 7 | 66 | 0.90 | 0.04 | No breakage | No breakage | 4.0 | 20 | 65.9 |
| Comp Ex X5 | 548 | 499 | 6 | 64 | 0.91 | 0.04 | No breakage | No breakage | 3.2 | 20 | 63.5 |
| Comp Ex X6 | 540 | 491 | 5 | 62 | 0.91 | 0.04 | No breakage | 290 | 2.6 | 20 | 62.6 |
| Ex 42B-1 | 598 | 520 | 10 | 89 | 0.87 | 0.08 | No breakage | No breakage | 5.6 | 20 | 72.6 |
| Ex 42 | 590 | 519 | 9 | 89 | 0.88 | 0.08 | No breakage | No breakage | 5.0 | 20 | 71.0 |
| Ex 42B-2 | 583 | 513 | 9 | 88 | 0.88 | 0.07 | No breakage | No breakage | 4.9 | 20 | 70.2 |
| Ex 42B-3 | 581 | 517 | 7 | 86 | 0.89 | 0.06 | No breakage | No breakage | 4.1 | 20 | 69.2 |
| Comp Ex X7 | 592 | 527 | 6 | 86 | 0.89 | 0.06 | No breakage | No breakage | 3.4 | 20 | 70.5 |
| Comp Ex X8 | 584 | 526 | 6 | 83 | 0.90 | 0.06 | No breakage | No breakage | 3.3 | 20 | 68.7 |
| Ex 47B-1 | 530 | 429 | 9 | 68 | 0.81 | 0.11 | No breakage | No breakage | 4.4 | 20 | 66.4 |
| Ex 47 | 524 | 424 | 9 | 67 | 0.81 | 0.10 | No breakage | No breakage | 4.4 | 20 | 65.6 |
| Ex 47B-2 | 522 | 412 | 9 | 66 | 0.79 | 0.11 | No breakage | No breakage | 4.4 | 20 | 65.6 |
| Ex 47B-3 | 531 | 419 | 8 | 66 | 0.79 | 0.13 | No breakage | No breakage | 4.0 | 20 | 66.8 |
| Comp Ex X9 | 525 | 415 | 6 | 64 | 0.79 | 0.11 | No breakage | No breakage | 2.9 | 20 | 66.0 |
| Comp Ex X10 | 517 | 408 | 5 | 62 | 0.79 | 0.11 | No breakage | No breakage | 2.4 | 20 | 65.0 |

As is apparent from Table 3, when the value η is set to 5, 7, 9, or 11 (Examples 14, 14B-1 to 14B-3, 23, 23B-1 to 23B-3, 36, 36B-1 to 36B-3, 42, 42B-1 to 42B-3, 47, and 47B-1 to 47B-3 according to the present invention), those examples each are satisfactory in each of the properties. However, it is understood that, when the value η is set to each of 1 or 3 (Comparative examples X1 to X10), those comparative examples tend to become low in electrical conductivity, elongation, the number of repeated bendings to break, and load at impact breakdown, which are poor in any of those properties.

Examples 4

With respect to Examples 14, 20, 23, 29, and 42 according to the present invention in Table 1, electrical wire with sectional area 0.13 $mm^2$ were produced in the same manner as in Example 1, except that the solid wire with diameter 10 mm was subjected to the solution treatment at 750 to 950° C., thereby to change the solution treatment ratio $\rho/\rho_{FULL}$ into 0.5 to 0.9. Properties of the resultant electrical wires are shown in Table 4.

TABLE 4

| | Alloying elements (mass %) | | | | | | | Solution treatment ratio |
|---|---|---|---|---|---|---|---|---|
| | Cr | Zr | Sn | Ag | Mg | Zn | Cu | $\rho/\rho_{FULL}$ |
| Ex 14C-1 | 1.02 | 0.18 | | | | | Balance | 0.90 |
| Ex 14C-2 | 1.02 | 0.18 | | | | | Balance | 0.83 |
| Ex 14C-3 | 1.02 | 0.18 | | | | | Balance | 0.76 |
| Ex 14C-4 | 1.02 | 0.18 | | | | | Balance | 0.72 |
| Comp Ex Y1 | 1.02 | 0.18 | | | | | Balance | 0.65 |
| Comp Ex Y2 | 1.02 | 0.18 | | | | | Balance | 0.55 |
| Ex 20C-1 | 0.96 | | 0.17 | | | | Balance | 0.90 |
| Ex 20C-2 | 0.96 | | 0.17 | | | | Balance | 0.82 |
| Ex 20C-3 | 0.96 | | 0.17 | | | | Balance | 0.75 |
| Ex 20C-4 | 0.96 | | 0.17 | | | | Balance | 0.71 |
| Comp Ex Y3 | 0.96 | | 0.17 | | | | Balance | 0.64 |
| Comp Ex Y4 | 0.96 | | 0.17 | | | | Balance | 0.54 |
| Ex 23C-1 | 1.21 | | 0.29 | | | | Balance | 0.90 |
| Ex 23C-2 | 1.21 | | 0.29 | | | | Balance | 0.81 |
| Ex 23C-3 | 1.21 | | 0.29 | | | | Balance | 0.74 |
| Ex 23C-4 | 1.21 | | 0.29 | | | | Balance | 0.70 |
| Comp Ex Y5 | 1.21 | | 0.29 | | | | Balance | 0.63 |
| Comp Ex Y6 | 1.21 | | 0.29 | | | | Balance | 0.53 |
| Ex 29C-1 | 1.17 | | | 0.14 | 0.22 | | Balance | 0.89 |
| Ex 29C-2 | 1.17 | | | 0.14 | 0.22 | | Balance | 0.81 |
| Ex 29C-3 | 1.17 | | | 0.14 | 0.22 | | Balance | 0.74 |
| Ex 29C-4 | 1.17 | | | 0.14 | 0.22 | | Balance | 0.70 |
| Comp Ex Y7 | 1.17 | | | 0.14 | 0.22 | | Balance | 0.63 |
| Comp Ex Y8 | 1.17 | | | 0.14 | 0.22 | | Balance | 0.52 |
| Ex 42C-1 | 1.23 | 0.12 | | | | 0.53 | Balance | 0.90 |
| Ex 42C-2 | 1.23 | 0.12 | | | | 0.53 | Balance | 0.82 |
| Ex 42C-3 | 1.23 | 0.12 | | | | 0.53 | Balance | 0.75 |
| Ex 42C-4 | 1.23 | 0.12 | | | | 0.53 | Balance | 0.71 |
| Comp Ex Y9 | 1.23 | 0.12 | | | | 0.53 | Balance | 0.65 |
| Comp Ex Y10 | 1.23 | 0.12 | | | | 0.53 | Balance | 0.54 |

TABLE 4-continued

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Ex 14C-1 | 530 | 445 | 11 | 90 | 0.84 | 0.10 | No breakage | No breakage | 5.4 | 20 | 65.7 |
| Ex 14C-2 | 500 | 425 | 10 | 91 | 0.85 | 0.09 | No breakage | No breakage | 4.7 | 20 | 61.6 |
| Ex 14C-3 | 460 | 391 | 11 | 90 | 0.85 | 0.10 | No breakage | No breakage | 4.7 | 20 | 56.7 |
| Ex 14C-4 | 426 | 358 | 10 | 91 | 0.84 | 0.10 | No breakage | No breakage | 4.0 | 20 | 52.8 |
| Comp Ex Y1 | 393 | 334 | 10 | 92 | 0.85 | 0.09 | No breakage | 290 | 3.7 | 20 | 48.4 |
| Comp Ex Y2 | 365 | 314 | 9 | 93 | 0.86 | 0.09 | 2,600 | 250 | 3.1 | 20 | 44.7 |
| Ex 20C-1 | 525 | 446 | 11 | 86 | 0.85 | 0.09 | No breakage | No breakage | 5.4 | 20 | 64.7 |
| Ex 20C-2 | 493 | 429 | 10 | 86 | 0.87 | 0.08 | No breakage | No breakage | 4.6 | 20 | 59.9 |
| Ex 20C-3 | 468 | 402 | 9 | 88 | 0.86 | 0.09 | No breakage | No breakage | 4.0 | 20 | 57.3 |
| Ex 20C-4 | 429 | 365 | 10 | 87 | 0.85 | 0.08 | No breakage | No breakage | 4.1 | 20 | 52.9 |
| Comp Ex Y3 | 390 | 328 | 10 | 89 | 0.84 | 0.10 | No breakage | No breakage | 3.7 | 20 | 48.3 |
| Comp Ex Y4 | 374 | 322 | 11 | 89 | 0.86 | 0.08 | 2,700 | 250 | 3.9 | 20 | 45.8 |
| Ex 23C-1 | 561 | 438 | 10 | 75 | 0.78 | 0.14 | No breakage | No breakage | 5.1 | 20 | 70.6 |
| Ex 23C-2 | 531 | 419 | 10 | 75 | 0.79 | 0.13 | No breakage | No breakage | 4.9 | 20 | 66.8 |
| Ex 23C-3 | 502 | 392 | 11 | 76 | 0.78 | 0.14 | No breakage | No breakage | 5.0 | 20 | 63.2 |
| Ex 23C-4 | 478 | 378 | 10 | 75 | 0.79 | 0.13 | No breakage | No breakage | 4.4 | 20 | 60.1 |
| Comp Ex Y5 | 424 | 335 | 10 | 77 | 0.79 | 0.14 | No breakage | No breakage | 3.9 | 20 | 53.3 |
| Comp Ex Y6 | 395 | 308 | 10 | 76 | 0.78 | 0.13 | No breakage | No breakage | 3.7 | 20 | 49.7 |
| Ex 29C-1 | 545 | 431 | 10 | 76 | 0.79 | 0.15 | No breakage | No breakage | 5.0 | 20 | 68.5 |
| Ex 29C-2 | 510 | 403 | 11 | 77 | 0.79 | 0.13 | No breakage | No breakage | 5.2 | 20 | 64.1 |
| Ex 29C-3 | 476 | 381 | 10 | 78 | 0.80 | 0.15 | No breakage | No breakage | 4.3 | 20 | 59.8 |
| Ex 29C-4 | 453 | 358 | 11 | 77 | 0.79 | 0.12 | No breakage | No breakage | 4.6 | 20 | 57.0 |
| Comp Ex Y7 | 412 | 330 | 10 | 78 | 0.80 | 0.13 | No breakage | No breakage | 3.8 | 20 | 51.7 |
| Comp Ex Y8 | 374 | 303 | 9 | 79 | 0.81 | 0.11 | 2,700 | 290 | 3.1 | 20 | 46.9 |
| Ex 42C-1 | 582 | 512 | 9 | 88 | 0.88 | 0.08 | No breakage | No breakage | 4.9 | 20 | 70.0 |
| Ex 42C-2 | 558 | 497 | 9 | 89 | 0.89 | 0.07 | No breakage | No breakage | 4.7 | 20 | 66.4 |
| Ex 42C-3 | 514 | 452 | 10 | 89 | 0.88 | 0.08 | No breakage | No breakage | 4.8 | 20 | 61.9 |
| Ex 42C-4 | 504 | 449 | 10 | 89 | 0.89 | 0.07 | No breakage | No breakage | 4.8 | 20 | 60.0 |
| Comp Ex Y9 | 460 | 414 | 9 | 90 | 0.90 | 0.07 | No breakage | No breakage | 3.9 | 20 | 54.1 |
| Comp Ex Y10 | 395 | 356 | 9 | 91 | 0.90 | 0.06 | 2,900 | 220 | 3.4 | 20 | 46.5 |

As is apparent from Table 4, the examples in which the solution treatment ratio is 0.7 or more (Examples 14C-1 to 14C-4, 20C-1 to 20C-4, 23C-1 to 23C-4, 29C-1 to 29C-4, and 42C-1 to 42C-4 according to the present invention) each are satisfactory in each of the properties. However, when the solution treatment ratio is less than 0.7 (Comparative examples Y1 to Y10), the mechanical strengths, such as the tensile strength, and the load at impact breakdown, and the number of repeated bendings to break, and further the terminal crimping strength after the electric-wire-crimping, are lowered to be poor.

Comparative Examples 1 and Reference Examples

Table 5 shows comparative examples and reference examples. The respective comparative examples and reference examples are as follows:

Comparative examples 1 to 7 each are a comparative example, in which the composition of an alloy was set outside the scope of the present invention.

Comparative examples 8 to 15 each are a comparative example, in which, in Example 5 and 14 according to the present invention in Table 1, the Y/T ratio was set to 0.96, which is larger than the range according to the present invention, by changing the conditions for the aging heat treatment after the stranding to conditions for keeping at 500° C. for 30 seconds, the n value was set to 0.02, which is smaller than the range according to the present invention, and the sectional area reduction in the crimping was set to 10, 20, 30, or 40%.

Comparative examples 16 to 23 each are a comparative example, in which, in Example 20 and 29 according to the present invention in Table 1, the Y/T ratio was set to 0.96 or 0.65, which is smaller than the range according to the present invention, by changing the conditions for the aging heat treatment after the stranding to conditions for keeping at 570° C. for 8 hours, the n value was set to 0.19 or 0.21, which is larger than the range according to the present invention, and the sectional area reduction in the crimping was set to 10, 20, 30, or 40%.

Reference examples 1 to 8 each are a reference example, in which, in Example 5, 14, 20 and 29 according to the present invention in Table 1, the sectional area reduction in the crimping was made as large as 50% or 60%.

In the following tables, a reference example (i.e. Reference example) is abbreviated to "Ref Ex".

TABLE 5

| | Alloying elements (mass %) | | | | | | | | |
|---|---|---|---|---|---|---|---|---|---|
| | Cr | Zr | Sn | Ag | Mg | In | Si | Zn | Cu |
| Comp Ex 1 | 0.26 | | | | | | | | Balance |
| Comp Ex 2 | 0.18 | 0 | | | | | | | Balance |
| Comp Ex 3 | 0.68 | | 0.72 | | | | | | Balance |

TABLE 5-continued

| | | | | | | | | | |
|---|---|---|---|---|---|---|---|---|---|
| Comp Ex 4 | 0.70 | | | | | 0.88 | | | Balance |
| Comp Ex 5 | 0.67 | | 0.47 | | 0.30 | 0.24 | | | Balance |
| Comp Ex 6 | 0.66 | | 0.53 | | | | | 2.00 | Balance |
| Comp Ex 7 | 0.73 | | | | | | 0.19 | | Balance |
| Comp Ex 8 | 1.12 | | | | | | | | Balance |
| Comp Ex 9 | 1.12 | | | | | | | | Balance |
| Comp Ex 10 | 1.12 | | | | | | | | Balance |
| Comp Ex 11 | 1.12 | | | | | | | | Balance |
| Comp Ex 12 | 1.02 | 0.18 | | | | | | | Balance |
| Comp Ex 13 | 1.02 | 0.18 | | | | | | | Balance |
| Comp Ex 14 | 1.02 | 0.18 | | | | | | | Balance |
| Comp Ex 15 | 1.02 | 0.18 | | | | | | | Balance |
| Comp Ex 16 | 0.96 | | 0.17 | | | | | | Balance |
| Comp Ex 17 | 0.96 | | 0.17 | | | | | | Balance |
| Comp Ex 18 | 0.96 | | 0.17 | | | | | | Balance |
| Comp Ex 19 | 0.96 | | 0.17 | | | | | | Balance |
| Comp Ex 20 | 1.17 | | | 0.14 | 0.22 | | | | Balance |
| Comp Ex 21 | 1.17 | | | 0.14 | 0.22 | | | | Balance |
| Comp Ex 22 | 1.17 | | | 0.14 | 0.22 | | | | Balance |
| Comp Ex 23 | 1.17 | | | 0.14 | 0.22 | | | | Balance |
| Ref Ex 1 | 1.12 | | | | | | | | Balance |
| Ref Ex 2 | 1.12 | | | | | | | | Balance |
| Ref Ex 3 | 1.02 | 0.18 | | | | | | | Balance |
| Ref Ex 4 | 1.02 | 0.18 | | | | | | | Balance |
| Ref Ex 5 | 0.96 | | 0.17 | | | | | | Balance |
| Ref Ex 6 | 0.96 | | 0.17 | | | | | | Balance |
| Ref Ex 7 | 1.17 | | | 0.14 | 0.22 | | | | Balance |
| Ref Ex 8 | 1.17 | | | 0.14 | 0.22 | | | | Balance |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Comp Ex 1 | 386 | 278 | 12 | 93 | 0.72 | 0.16 | 2,900 | No breakage | 4.2 | 20 | 48.7 |
| Comp Ex 2 | 362 | 264 | 11 | 94 | 0.73 | 0.15 | 2,500 | No breakage | 3.7 | 20 | 45.6 |
| Comp Ex 3 | 519 | 415 | 10 | 60 | 0.80 | 0.11 | No breakage | No breakage | 4.8 | 20 | 65.2 |
| Comp Ex 4 | 536 | 461 | 9 | 64 | 0.86 | 0.09 | No breakage | No breakage | 4.5 | 20 | 65.6 |
| Comp Ex 5 | 548 | 504 | 7 | 52 | 0.92 | 0.04 | No breakage | No breakage | 3.7 | 20 | 62.5 |
| Comp Ex 6 | 561 | 466 | 11 | 55 | 0.83 | 0.09 | No breakage | No breakage | 5.8 | 20 | 69.8 |
| Comp Ex 7 | 504 | 433 | 9 | 57 | 0.86 | 0.08 | No breakage | No breakage | 4.3 | 20 | 61.7 |
| Comp Ex 8 | 566 | 543 | 5 | 86 | 0.96 | 0.02 | No breakage | 180 | 2.8 | 10 | 67.1 |
| Comp Ex 9 | 566 | 543 | 5 | 86 | 0.96 | 0.02 | No breakage | 180 | 2.8 | 20 | 59.0 |
| Comp Ex 10 | 566 | 543 | 5 | 86 | 0.96 | 0.02 | No breakage | 180 | 2.8 | 30 | 52.6 |
| Comp Ex 11 | 566 | 543 | 5 | 86 | 0.96 | 0.02 | No breakage | 180 | 2.8 | 40 | 43.3 |
| Comp Ex 12 | 612 | 588 | 3 | 73 | 0.96 | 0.02 | No breakage | 220 | 1.8 | 10 | 72.5 |
| Comp Ex 13 | 612 | 588 | 3 | 73 | 0.96 | 0.02 | No breakage | 220 | 1.8 | 20 | 63.8 |
| Comp Ex 14 | 612 | 588 | 3 | 73 | 0.96 | 0.02 | No breakage | 220 | 1.8 | 30 | 56.9 |
| Comp Ex 15 | 612 | 588 | 3 | 73 | 0.96 | 0.02 | No breakage | 200 | 1.8 | 40 | 46.8 |
| Comp Ex 16 | 375 | 259 | 17 | 79 | 0.69 | 0.19 | 2,700 | No breakage | 5.8 | 10 | 47.7 |
| Comp Ex 17 | 375 | 259 | 17 | 79 | 0.69 | 0.19 | 2,700 | No breakage | 5.8 | 20 | 47.4 |
| Comp Ex 18 | 375 | 259 | 17 | 79 | 0.69 | 0.19 | 2,700 | No breakage | 5.8 | 30 | 44.7 |
| Comp Ex 19 | 375 | 259 | 17 | 79 | 0.69 | 0.19 | 2,700 | No breakage | 5.8 | 40 | 41.4 |
| Comp Ex 20 | 358 | 233 | 19 | 73 | 0.65 | 0.21 | 2,400 | No breakage | 6.1 | 10 | 44.1 |
| Comp Ex 21 | 358 | 233 | 19 | 73 | 0.65 | 0.21 | 2,400 | No breakage | 6.1 | 20 | 45.7 |
| Comp Ex 22 | 358 | 233 | 19 | 73 | 0.65 | 0.21 | 2,400 | No breakage | 6.1 | 30 | 46.3 |
| Comp Ex 23 | 358 | 233 | 19 | 73 | 0.65 | 0.21 | 2,400 | No breakage | 6.1 | 40 | 44.5 |
| Ref Ex 1 | 483 | 348 | 13 | 91 | 0.72 | 0.16 | No breakage | No breakage | 5.7 | 50 | 44.2 |
| Ref Ex 2 | 483 | 348 | 13 | 91 | 0.72 | 0.16 | No breakage | No breakage | 5.7 | 60 | 37.9 |
| Ref Ex 3 | 524 | 445 | 10 | 91 | 0.85 | 0.09 | No breakage | No breakage | 4.9 | 50 | 47.1 |
| Ref Ex 4 | 524 | 445 | 10 | 91 | 0.85 | 0.09 | No breakage | No breakage | 4.9 | 60 | 40.9 |
| Ref Ex 5 | 523 | 439 | 11 | 86 | 0.84 | 0.08 | No breakage | No breakage | 5.4 | 50 | 47.1 |
| Ref Ex 6 | 523 | 439 | 11 | 86 | 0.84 | 0.08 | No breakage | No breakage | 5.4 | 60 | 41.0 |
| Ref Ex 7 | 539 | 426 | 10 | 77 | 0.79 | 0.15 | No breakage | No breakage | 4.9 | 50 | 48.2 |
| Ref Ex 8 | 539 | 426 | 10 | 77 | 0.79 | 0.15 | No breakage | No breakage | 4.9 | 60 | 41.8 |

As is apparent from Table 5, evaluation results of the respective comparative examples and reference examples are as follows:

Comparative examples 1 to 7 are outside the scope of the present invention in the point of the alloy compositions, and satisfactory properties are not obtained in any one or more of the evaluated items.

Comparative examples 8 to 15 are poor in elongation, the number of repeated bendings to break, and load at impact breakdown, as compared to Examples 5 and 14 according to the present invention, and the terminal crimping strengths each are below 50 N at the sectional area reduction of 40%.

Comparative examples 16 to 23 are poor in tensile strength, the number of repeated bendings to break, and terminal crimping strength, as compared to Examples 20 and 29 according to the present invention.

Reference examples 1 to 8 each showed the terminal crimping strength below 50 N, which are poor, as compared to Examples 5, 14, 20, and 29 according to the present invention.

Conventional Examples

Table 6 shows conventional examples. The conventional examples each were produced through the following steps. That is, from each alloy having an alloy composition shown in Table 6, rough drawn wires (correspond to copper alloy solid wires) 20 mm in diameter were produced in a continuous casting and rolling machine by the method described in paragraph 0032 of the above-mentioned Patent Literature 1. Then, the wires were cold drawn, to give solid wires 0.175 mm in diameter. Seven of the solid wires were stranded, and further compressed to give a stranded wire with sectional area 0.13 $mm^2$. Further, the stranded wire was covered with an insulating substance (polyethylene). In this way, each electrical wire for wiring was obtained. The thus-obtained stranded wires were annealed (via a heat treatment to a reached temperature of 700° C. reached in a time period of 0.5 second) by an electrical heating apparatus, which are named Conventional examples 1 and 3, respectively. Separately, the stranded wires were not subjected to any annealing, which are named Conventional examples 2 and 4, respectively. Properties thereof were measured in the same manners as in the items [1] to [8] above.

In the following tables, a conventional example (i.e. Conventional example) is abbreviated to "Cony Ex".

alloy wire materials 0.175 mm in diameter. Seven of the wire materials wires were stranded, and further compressed, to give a stranded wire with sectional area 0.13 $mm^2$. The wire-drawing ratio η at that time was 7. The stranded wire was subjected to aging heat treatment at 400 to 450° C. for 2 hours. In this way, each conductor of an electrical wire for wiring was obtained in which the Y/T ratio and the n value each were within the range specified in the present invention. Separately, the same stranded wire as described above was subjected to aging heat treatment at 500° C. for 30 seconds or at 570° C. for 8 hours. In this way, each conductor of an electrical wire for wiring was obtained in which the Y/T ratio and the n value each were outside the ranges specified in the present invention.

Further, separately, with respect to the copper alloy solid wires 6 mmϕ in diameter, the wires were drawn into diameter 0.07, 0.5, or 1.3 mm, followed by stranding seven of the thus-drawn wires, to obtain a stranded wire, respectively. The thus-stranded wires were subjected to aging heat treatment in the same manner as described above, to obtain conductors of electrical wires for wiring having varied wire-drawing ratios η of 9, 5, and 3, respectively.

Each of the resultant conductors of electrical wires was covered with an insulating substance in the same manner as in Example 1 described in the present specification, to give electrical wires for wiring, respectively, and properties thereof were then evaluated in the same manner as in Example 1. The results are shown in Table 7. The number in parentheses attached to each of sample numbers in Table 7 corresponds to the alloy No. described in Examples of Patent Literature 3. For example, the expression "Ex 49 (66)" means that this example according to the present invention, has the same alloy composition as "Ex 49", as well as the same alloy composition as the alloy No. 66 in Patent Literature 3. Since the examples or comparative examples in which the wire-drawing ratio η is any one of 9, 5, and 3, are different in the wire diameter from the examples in which the wire-drawing ratio η is 7, the former examples or comparative examples cannot be directly compared with the latter examples on the number of repeated bendings to break, the load at impact breakdown, and the terminal crimping strength. Thus, no results on those items of the former examples or comparative examples are shown in Table 7.

TABLE 6

| | Alloying elements (mass %) | |
|---|---|---|
| | Sn | Cu |
| Conv Ex 1 | | Balance |
| Conv Ex 2 | | Balance |
| Conv Ex 3 | 0.30 | Balance |
| Conv Ex 4 | 0.30 | Balance |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Conv Ex 1 | 214 | 101 | 20 | 100 | 0.47 | 0.34 | 350 | 80 | 3.7 | 20 | 23.6 |
| Conv Ex 2 | 447 | 416 | 2 | 99 | 0.93 | 0.08 | No breakage | 220 | 0.9 | 20 | 34.9 |
| Conv Ex 3 | 280 | 143 | 19 | 78 | 0.51 | 0.29 | 1,150 | 230 | 4.7 | 20 | 30.9 |
| Conv Ex 4 | 841 | 782 | 2 | 77 | 0.93 | 0.04 | No breakage | 220 | 1.6 | 20 | 65.6 |

As is apparent from Table 6, evaluation results of the respective conventional examples are as follows.

It is understood that Conventional examples 1 to 4 each are poor in at least one of tensile strength, elongation, flexibility, impact breakdown strength, and terminal crimping strength, and they are impracticable.

Examples 5

Copper alloys of Nos. 66, 70, and 79 described in Tables 5 and 6 in Patent Literature 3 described above, each were produced by the method in Example 5 or 6 described in paragraphs 0045 and 0048 of Patent Literature 3, and copper alloy solid wires 6 mmϕ in diameter were obtained. Then, the copper alloy solid wires were cold drawn, to obtain copper

TABLE 7

| | Alloying elements (mass %) | | | | Wire diameter | Wire-drawing ratio η |
|---|---|---|---|---|---|---|
| | Cr | Zr | Sn | Cu | (ϕmm) | before aging |
| Ex 49 (66) | 0.52 | | | Balance | 0.175 | 7 |
| Comp Ex Z1 | 0.52 | | | Balance | 0.175 | 7 |
| Comp Ex Z2 | 0.52 | | | Balance | 0.175 | 7 |
| Ex 49D-1 | 0.52 | | | Balance | 0.07 | 9 |
| Ex 49D-2 | 0.52 | | | Balance | 0.5 | 5 |
| Comp Ex Z3 | 0.52 | | | Balance | 1.3 | 3 |
| Ex 50 (70) | 0.65 | | 0.48 | Balance | 0.175 | 7 |
| Comp Ex Z4 | 0.65 | | 0.48 | Balance | 0.175 | 7 |
| Comp Ex Z5 | 0.65 | | 0.48 | Balance | 0.175 | 7 |
| Ex 50D-1 | 0.65 | | 0.48 | Balance | 0.07 | 9 |
| Ex 50D-2 | 0.65 | | 0.48 | Balance | 0.5 | 5 |
| Comp Ex Z6 | 0.65 | | 0.48 | Balance | 1.3 | 3 |
| Ex 51 (79) | 0.52 | 0.20 | | Balance | 0.175 | 7 |
| Comp Ex Z7 | 0.52 | 0.20 | | Balance | 0.175 | 7 |
| Comp Ex Z8 | 0.52 | 0.20 | | Balance | 0.175 | 7 |
| Ex 51D-1 | 0.52 | 0.20 | | Balance | 0.07 | 9 |
| Ex 51D-2 | 0.52 | 0.20 | | Balance | 0.5 | 5 |
| Comp Ex Z9 | 0.52 | 0.20 | | Balance | 1.3 | 3 |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Ex 49 (66) | 431 | 323 | 10 | 93 | 0.75 | 0.14 | No breakage | No breakage | 4.0 | 20 | 54.3 |
| Comp Ex Z1 | 506 | 486 | 4 | 85 | 0.96 | 0.02 | No breakage | 160 | 2.0 | 20 | 52.8 |
| Comp Ex Z2 | 334 | 217 | 16 | 89 | 0.65 | 0.20 | 2000 | No breakage | 4.8 | 20 | 42.7 |
| Ex 49D-1 | 430 | 327 | 11 | 94 | 0.76 | 0.14 | | | | | |
| Ex 49D-2 | 418 | 318 | 8 | 91 | 0.76 | 0.15 | | | | | |
| Comp Ex Z3 | 415 | 320 | 6 | 89 | 0.77 | 0.14 | | | | | |
| Ex 50 (70) | 525 | 420 | 10 | 68 | 0.80 | 0.12 | No breakage | No breakage | 4.8 | 20 | 65.9 |
| Comp Ex Z4 | 610 | 586 | 5 | 60 | 0.96 | 0.02 | No breakage | 230 | 3.0 | 20 | 63.6 |
| Comp Ex Z5 | 361 | 238 | 15 | 65 | 0.66 | 0.21 | 2500 | No breakage | 4.8 | 20 | 46.0 |
| Ex 50D-1 | 531 | 425 | 11 | 69 | 0.80 | 0.12 | | | | | |
| Ex 50D-2 | 520 | 411 | 9 | 66 | 0.79 | 0.13 | | | | | |
| Comp Ex Z6 | 522 | 407 | 5 | 63 | 0.78 | 0.14 | | | | | |
| Ex 51 (79) | 486 | 374 | 12 | 90 | 0.77 | 0.14 | No breakage | No breakage | 5.3 | 20 | 61.2 |
| Comp Ex Z7 | 578 | 561 | 6 | 84 | 0.97 | 0.02 | No breakage | 210 | 3.4 | 20 | 58.5 |
| Comp Ex Z8 | 353 | 226 | 16 | 88 | 0.64 | 0.22 | 2400 | No breakage | 5.0 | 20 | 45.3 |
| Ex 51D-1 | 491 | 373 | 12 | 92 | 0.76 | 0.15 | | | | | |
| Ex 51D-2 | 480 | 370 | 9 | 88 | 0.77 | 0.14 | | | | | |
| Comp Ex Z9 | 475 | 361 | 6 | 86 | 0.76 | 0.15 | | | | | |

As is apparent from Table 7, the following are understood. In the case of using the solid wires produced, according to the method described in Patent Literature 3, excellent results are exhibited in the respective properties when their Y/T ratios, n values, and wire-drawing ratios before the aging are set into the respective ranges specified in the present invention (Examples 49, 49D-1, 49D-2, 50, 50D-1, 50D-2, 51, 51D-1, and 51D-2 according to the present invention). Contrary to the above, when the Y/T ratio and the n value are set outside the respective ranges specified in the present invention (Comparative examples Z1, Z2, Z4, Z5, Z7, and Z8), they are poor in any one of the properties of tensile strength, elongation, the number of repeated bendings to break, impact breakdown strength, and terminal crimping strength. When the value η is set outside the range specified in the present invention (Comparative examples Z3, Z6, and Z9), they are poor in elongation. From those matters, it is understood that only the solid-wire-producing method described in Patent Literature 3 can neither give satisfactory properties for a conductor of an electrical wire for wiring, nor an electrical wire for wiring.

Comparative Examples 2

The following describes another comparative examples. Copper alloys of Nos. 19 and 23 described in Table 1 of the above-described Patent Literature 4, were subjected to aging treatment via continuous heating at 350° C. for 30 seconds, or at 600° C. for 1,200 seconds (20 minutes), according to the method recited in claim 3 in Patent Literature 4. Conductors to be subjected for the aging treatment each were stranded wires with sectional area 0.13 $mm^2$, as produced through the same steps as in Example 1 described in the present specification. The results are shown in Table 8. The number in parentheses attached to each sample number in Table 8 corresponds to the alloy No. described in Table 1 of Patent Literature 4. For example, the expression "Comp Ex 24 (19)" means that this comparative example has the same alloy composition as the alloy No. 19 in Patent Literature 4.

TABLE 8

| | Alloying elements (mass %) | | | Heating conditions |
|---|---|---|---|---|
| | Cr | Zr | Cu | in continuous furnace |
| Comp Ex 24 (19) | 0.92 | | Balance | 350° C. × 30 sec |
| Comp Ex 25 (19) | 0.92 | | Balance | 600° C. × 1200 sec |
| Comp Ex 26 (23) | 0.91 | 0.22 | Balance | 350° C. × 30 sec |
| Comp Ex 27 (23) | 0.91 | 0.22 | Balance | 600° C. × 1200 sec |

| | Before crimping | | | | | | | | | After crimped | |
|---|---|---|---|---|---|---|---|---|---|---|---|
| | TS | YS | El | EC | Y/T | n | The number of repeated bendings to break | | Load at impact breakdown | Sectional area reduction upon crimping | Terminal crimping strength |
| | (MPa) | (MPa) | (%) | (% IACS) | ratio | value | Low strain | High strain | (N) | (%) | (N) |
| Comp Ex 24 (19) | 682 | 662 | 2 | 74 | 0.97 | 0.02 | No breakage | 270 | 1.4 | 20 | 69.0 |
| Comp Ex 25 (19) | 321 | 202 | 19 | 92 | 0.63 | 0.23 | 1,800 | No breakage | 5.4 | 20 | 41.4 |
| Comp Ex 26 (23) | 711 | 690 | 2 | 68 | 0.97 | 0.02 | No breakage | 290 | 1.4 | 20 | 72.0 |
| Comp Ex 27 (23) | 328 | 203 | 18 | 91 | 0.62 | 0.24 | 1,900 | No breakage | 5.2 | 20 | 42.6 |

As is apparent from Table 8, it is understood that in the case of using the aging annealing method described in Patent Literature 4 as described above (Comparative examples 24 to 27), the Y/T ratio or the n value turns outside the respective ranges specified in the present invention, and any one of the resultant properties are poor in tensile strength, elongation, the number of repeated bendings to break, impact breakdown strength, and terminal crimping strength.

The invention claimed is:

1. A conductor of an electrical wire for wiring, which is obtained by stranding a plurality of copper alloy wire materials each having a composition containing 0.3 to 1.5 mass % of Cr, with the balance being Cu and inevitable impurities, and which has a tensile strength of 400 MPa or more and 650 MPa or less, an elongation of 7% or more when broken, an electrical conductivity of 65% IACS or more, a ratio between a 0.2% proof stress and the tensile strength of 0.7 or more and 0.95 or less, and a work-hardening exponent of 0.03 or more and 0.17 or less.

2. The conductor of an electrical wire for wiring according to claim 1, wherein the composition of the copper alloy wire materials further contains at least one selected from the group consisting of 0.1 to 0.6 mass % of Sn, 0.005 to 0.3 mass % of Ag, 0.05 to 0.4 mass % of Mg, 0.1 to 0.8 mass % of In, and 0.01 to 0.15 mass % of Si.

3. The conductor of an electrical wire for wiring according to claim 2, wherein the composition of the copper alloy wire materials contains the at least one selected from the group consisting of 0.1 to 0.6 mass % of Sn, 0.005 to 0.3 mass % of Ag, 0.05 to 0.4 mass % of Mg, 0.1 to 0.8 mass % of In, and 0.01 to 0.15 mass % of Si, in a total content thereof in an amount of 0.005 to 0.8 mass %.

4. The conductor of an electrical wire for wiring according to claim 1, wherein the composition of the copper alloy wire materials further contains 0.1 to 1.5 mass % of Zn.

5. A method of producing the conductor of an electrical wire for wiring according to claim 1, comprising the steps of:

subjecting a copper alloy having the composition to solution treatment;

drawing the copper alloy to a predetermined wire diameter, to give the copper alloy wire materials;

stranding a plurality of the copper alloy wire materials, to give a stranded wire;

compressing the stranded wire; and subjecting the stranded wire thus compressed to aging heat treatment at 300 to 550° C. for 1 minute to 5 hours.

6. The method of producing the conductor of an electrical wire for wiring according to claim 5, wherein a wire-drawing ratio $\eta$ in the drawing step is 5 or more, which is represented by: $\eta=\ln(A_0/A_1)$, in which $A_0$ represents a cross sectional area of the material just after the solution treatment, and $A_1$ represents a cross sectional area of the material just before the aging.

7. The method of producing the conductor of an electrical wire for wiring according to claim 5, wherein the solution treatment is carried out via (i) hot working or (ii) continuous casting-and-rolling of the copper alloy.

8. An electrical wire for wiring, wherein an insulating cover is provided on the conductor of an electrical wire for wiring according to claim 1.

9. A copper alloy solid wire, which is used for the copper alloy wire materials in the conductor of an electrical wire for wiring according to claim 1, which has the composition according to claim 1, and which has an electrical resistivity of 70% or more of an electrical resistivity after conducted the solution treatment fully.

10. The conductor of an electrical wire for wiring according to claim 1, which is obtained by the steps of:

(i) hot working or (ii) continuous casting-and-rolling of a copper alloy having the composition, in which the (i) hot working or (ii) continuous casting-and-rolling functions also as solution treatment of the copper alloy; and the stranding of a plurality of the copper alloy wire materials.

11. An electrical wire for wiring, wherein an insulating cover is provided on the conductor of an electrical wire for wiring according to claim 10.

12. A copper alloy solid wire, which is used for the copper alloy wire materials in the conductor of an electrical wire for wiring according to claim 10, which has the composition according to claim 10, and which has an electrical resistivity of 70% or more of an electrical resistivity after conducting the solution treatment fully.

13. A conductor of an electrical wire for wiring, which is obtained by stranding a plurality of copper alloy wire materials each having a composition containing 0.3 to 1.5 mass % of Cr and 0.005 to 0.4 mass % of Zr, with the balance being Cu and inevitable impurities, and which has a tensile strength of 400 MPa or more and 650 MPa or less, an elongation of 7% or more when broken, an electrical conductivity of 65% IACS or more, a ratio between a 0.2% proof stress and the tensile strength of 0.7 or more and 0.95 or less, and a work-hardening exponent of 0.03 or more and 0.17 or less.

14. The conductor of an electrical wire for wiring according to claim 13, wherein the composition of the copper alloy wire materials further contains at least one selected from the group consisting of 0.1 to 0.6 mass % of Sn, 0.005 to 0.3 mass % of Ag, 0.05 to 0.4 mass % of Mg, 0.1 to 0.8 mass % of In, and 0.01 to 0.15 mass % of Si.

15. The conductor of an electrical wire for wiring according to claim 14, wherein the composition of the copper alloy wire materials contains the at least one selected from the group consisting of 0.1 to 0.6 mass % of Sn, 0.005 to 0.3 mass % of Ag, 0.05 to 0.4 mass % of Mg, 0.1 to 0.8 mass % of In, and 0.01 to 0.15 mass % of Si, in a total content thereof in an amount of 0.005 to 0.8 mass %.

16. The conductor of an electrical wire for wiring according to claim 13, wherein the composition of the copper alloy wire materials further contains 0.1 to 1.5 mass % of Zn.

17. A method of producing the conductor of an electrical wire for wiring according to claim 13, comprising the steps of:

subjecting a copper alloy having the composition to solution treatment;

drawing the copper alloy to a predetermined wire diameter, to give the copper alloy wire materials;

stranding a plurality of the copper alloy wire materials, to give a stranded wire;

compressing the stranded wire; and subjecting the stranded wire thus compressed to aging heat treatment at 300 to 550° C. for 1 minute to 5 hours.

18. The method of producing the conductor of an electrical wire for wiring according to claim 17, wherein a wire-drawing ratio $\eta$ in the drawing step is 5 or more, which is represented by: $\eta=\ln(A_0/A_1)$, in which $A_0$ represents a cross sectional area of the material just after the solution treatment, and $A_1$ represents a cross sectional area of the material just before the aging.

19. The method of producing the conductor of an electrical wire for wiring according to claim 17, wherein the solution treatment is carried out via (i) hot working or (ii) continuous casting-and-rolling of the copper alloy.

20. An electrical wire for wiring, wherein an insulating cover is provided on the conductor of an electrical wire for wiring according to claim 13.

21. A copper alloy solid wire, which is used for the copper alloy wire materials in the conductor of an electrical wire for wiring according to claim 13, which has the composition according to claim 13, and which has an electrical resistivity of 70% or more of an electrical resistivity after conducted the solution treatment fully.

22. The conductor of an electrical wire for wiring according to claim 13, which is obtained by the steps of:

(i) hot working or (ii) continuous casting-and-rolling of a copper alloy having the composition, in which the (i) hot working or (ii) continuous casting-and-rolling functions also as solution treatment of the copper alloy; and the stranding of a plurality of the copper alloy wire materials.

23. An electrical wire for wiring, wherein an insulating cover is provided on the conductor of an electrical wire for wiring according to claim 22.

24. A copper alloy solid wire, which is used for the copper alloy wire materials in the conductor of an electrical wire for wiring according to claim 22, which has the composition according to claim 22, and which has an electrical resistivity of 70% or more of an electrical resistivity after conducting the solution treatment fully.

* * * * *